US005711091A

United States Patent [19]

Bos

[11] Patent Number: 5,711,091

[45] Date of Patent: Jan. 27, 1998

[54] SOFFIT MOUNTED DRYER VENT

[76] Inventor: Jim Bos, 16641 18th Avenue, White Rock, British Columbia, Canada, V4P 2N9

[21] Appl. No.: 732,048

[22] Filed: Oct. 17, 1996

[51] Int. Cl.[6] ..... F26B 11/02

[52] U.S. Cl. ..... 34/606; 34/140; 454/353; D23/387; D23/393; 52/95; 52/220.8

[58] Field of Search ..... 34/86, 604, 606, 34/607, 138, 140, 235; 454/136, 332, 260, 333, 353, 365; D23/393, 387, 370; 285/64, 226, 168; 52/95, 220.8

[56] References Cited

U.S. PATENT DOCUMENTS

| | | | |
|---|---|---|---|
| 4,237,621 | 12/1980 | Boismenu | 34/140 X |
| 4,967,490 | 11/1990 | Berger et al. | 34/235 |
| 4,998,390 | 3/1991 | Glover et al. | 52/95 |
| 5,167,578 | 12/1992 | Legault | 454/350 |

*Primary Examiner*—Henry A. Bennett
*Assistant Examiner*—Steve Gravini

[57] ABSTRACT

A new Soffit Mounted Dryer Vent for offering a non-maintenance exhaust vent system for a clothes dryer vent that terminates in a soffit of a roof overhang. The inventive device includes a flange, a dryer hose adapter ring, an outlet fitting, and a vent flapper. The flange has an air passage, an upper surface, and a lower surface. The air passage allows exhaust air to pass through the flange from the dryer hose adapter ring to the outlet fitting. The dryer hose adapter ring is symmetrically mated to the upper surface of the flange. The dryer hose adapter ring has an outer wall diameter of substantially the same dimensions as the clothes dryer vent hose thereby allowing the clothes dry vent hose to matingly slip over the dryer hose adapter ring. The outlet fitting, having an outlet opening, is adjoiningly mated to the lower surface of the flange. The vent flapper is pivotally attached to the outlet fitting at the outlet opening.

In use, the clothes dryer vent hose is slipped over the dryer hose adapter ring. The flange is attached to a soffit of a roof overhang by a fastener, such as a screw or a nail. Exhaust air from the clothes dryer vent hose flows through the dryer hose adapter ring, through the air passage of the flange, and through the outlet fitting. The force of flowing exhaust air causes the vent flapper to pivot outward allowing exhaust air to exit through the outlet opening of the outlet fitting. When no exhaust air is flowing, a flapper stop prevents the vent flapper from pivotally rotating into the outlet fitting beyond a substantially vertical plane.

2 Claims, 3 Drawing Sheets

SOFFIT MOUNTED DRYER VENT

BACKGROUND OF THE INVENTION

1. Field of the Invention

The present invention relates to clothes dryer vents and more particularly pertains to a new Soffit Mounted Dryer Vent for offering a non-maintenance exhaust vent system for a clothes dryer vent that terminates in a soffit of a roof overhang.

2. Description of the Prior Art

The use of clothes dryer vents is known in the prior art. More specifically, clothes dryer vents heretofore devised and utilized are known to consist basically of familiar, expected and obvious structural configurations, notwithstanding the myriad of designs encompassed by the crowded prior art which have been developed for the fulfillment of countless objectives and requirements.

Known prior art clothes dryer vents include U.S. Pat. No. 4,121,351; U.S. Pat. No. 4,395,831; U.S. Pat. No. D277,131; U.S. Pat. No. 4,498,247; U.S. Pat. No. D281,451; and U.S. Pat. No. D335,174.

While these devices fulfill their respective, particular objectives and requirements, the aforementioned patents do not disclose a new Soffit Mounted Dryer Vent. The inventive device includes a flange, a dryer hose adapter ring, an outlet fitting, and a vent flapper.

In these respects, the Soffit Mounted Dryer Vent according to the present invention substantially departs from the conventional concepts and designs of the prior art, and in so doing provides an apparatus primarily developed for the purpose of offering a non-maintenance exhaust vent system for a clothes dryer vent that terminates in a soffit of a roof overhang.

SUMMARY OF THE INVENTION

In view of the foregoing disadvantages inherent in the known types of clothes dryer vents now present in the prior art, the present invention provides a new Soffit Mounted Dryer Vent construction wherein the same can be utilized for offering a non-maintenance exhaust vent system for a clothes dryer vent that terminates in a soffit of a roof overhang.

The general purpose of the present invention, which will be described subsequently in greater detail, is to provide a new Soffit Mounted Dryer Vent apparatus and method which has many of the advantages of the clothes dryer vents mentioned heretofore and many novel features that result in a new Soffit Mounted Dryer Vent which is not anticipated, rendered obvious, suggested, or even implied by any of the prior art clothes dryer vents, either alone or in any combination thereof.

To attain this, the present invention generally comprises a flange, a dryer hose adapter ring, an outlet fitting, and a vent flapper.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Soffit Mounted Dryer Vent apparatus and method which has many of the advantages of the clothes dryer vents mentioned heretofore and many novel features that result in a new Soffit Mounted Dryer Vent which is not anticipated, rendered obvious, suggested, or even implied by any of the prior art clothes dryer vents, either alone or in any combination thereof.

It is another object of the present invention to provide a new Soffit Mounted Dryer Vent which may be easily and efficiently manufactured and marketed.

It is a further object of the present invention to provide a new Soffit Mounted Dryer Vent which is of a durable and reliable construction.

An even further object of the present invention is to provide a new Soffit Mounted Dryer Vent which is susceptible of a low cost of manufacture with regard to both materials and labor, and which accordingly is then susceptible of low prices of sale to the consuming public, thereby making such Soffit Mounted Dryer Vent economically available to the buying public.

Still yet another object of the present invention is to provide a new Soffit Mounted Dryer Vent which provides in the apparatuses and methods of the prior art some of the advantages thereof, while simultaneously overcoming some of the disadvantages normally associated therewith.

Still another object of the present invention is to provide a new Soffit Mounted Dryer Vent for offering a non-maintenance exhaust vent system for a clothes dryer vent that terminates in a soffit of a roof overhang.

Yet another object of the present invention is to provide a new Soffit Mounted Dryer Vent which includes a flange, a dryer hose adapter ring, an outlet fitting, and a vent flapper.

Still yet another object of the present invention is to provide a new Soffit Mounted Dryer Vent that eliminates the use of a soffit screen which can become plugged with lint which in turn can cause overheating and damage to a clothes dryer and can also lead to longer drying time.

Even still another object of the present invention is to provide a new Soffit Mounted Dryer Vent that reduces maintenance by eliminating the need to frequently clean lint from an exhaust vent that uses a soffit screen.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
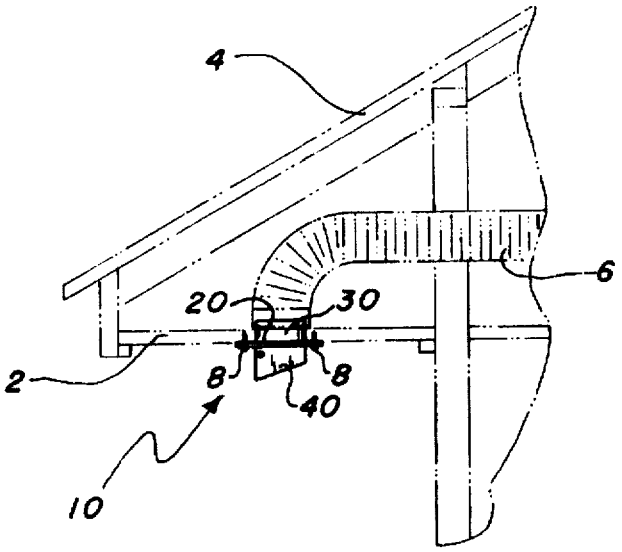
FIG. 1 is a side view of a new Soffit Mounted Dryer Vent installed in a soffit of a roof overhang according to the present invention.
Figure 2:
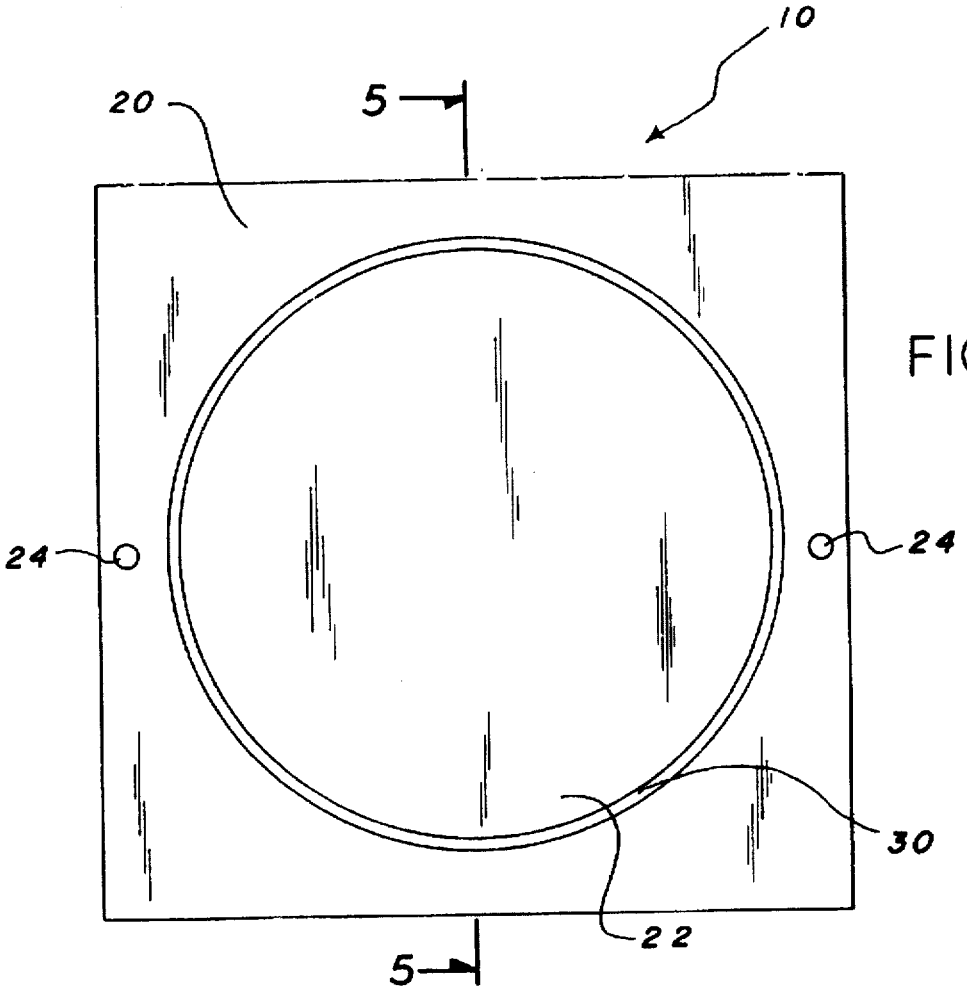
FIG. 2 is a top view of the present invention.

With reference now to the drawings, and in particular to FIGS. 1 through 6 thereof, a new Soffit Mounted Dryer Vent embodying the principles and concepts of the present invention and generally designated by the reference numeral 10 will be described.

More specifically, it will be noted that the Soffit Mounted Dryer Vent 10 comprises a flange 20, a dryer hose adapter ring 30, an outlet fitting 40, and a vent flapper 50. As best illustrated in FIGS. 1 through 6, the flange 20 has an air passage 22, an upper surface 26, and a lower surface 28. The air passage 22 allows exhaust air to pass through the flange 20 from the dryer hose adapter ring 30 to the outlet fitting 40. The dryer hose adapter ring 30 is symmetrically mated to the upper surface 26 of the flange 20. The dryer hose adapter ring 30 has an outer wall 32 with a diameter of substantially the same dimensions as a clothes dryer vent hose 6 thereby allowing the clothes dry vent hose 6 to matingly slip over the outer wall 32 of the dryer hose adapter ring 30.

Figure 6:
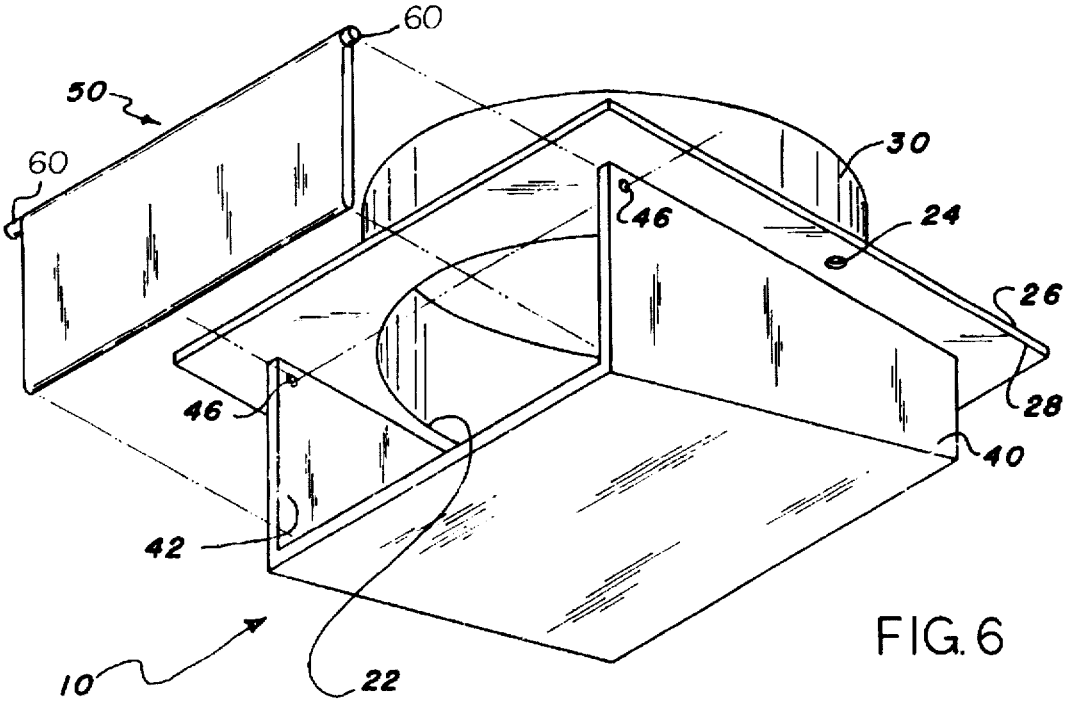
FIG. 6 is an exploded isometric illustration of the present invention.

The outlet fitting 40 is adjoiningly mated to the lower surface 28 of the flange 20. The outlet fitting 40 has an outlet opening 42 and an internal surface 48. The vent flapper 50 is pivotally attached to the outlet fitting 40 at the outlet opening 42. A flapper stop 44 protrudes from the internal surface 48 of the outlet fitting 40 at the outlet opening 42 preventing the vent flapper 50 from pivotally rotating into the outlet fitting 40 beyond a substantially vertical plane. As shown in FIG. 6, the vent flapper 50 is pivotally attached to the outlet fitting 40 by a pair of vent flapper pins 60, each pin 60 projecting from a side edge of vent flapper 50. The vent flapper 50 is made from flexible plastic which allows for the insertion of each vent flapper pin 60 into a flapper pin retention hole 46 of the outlet fitting 40.

Figure 3:
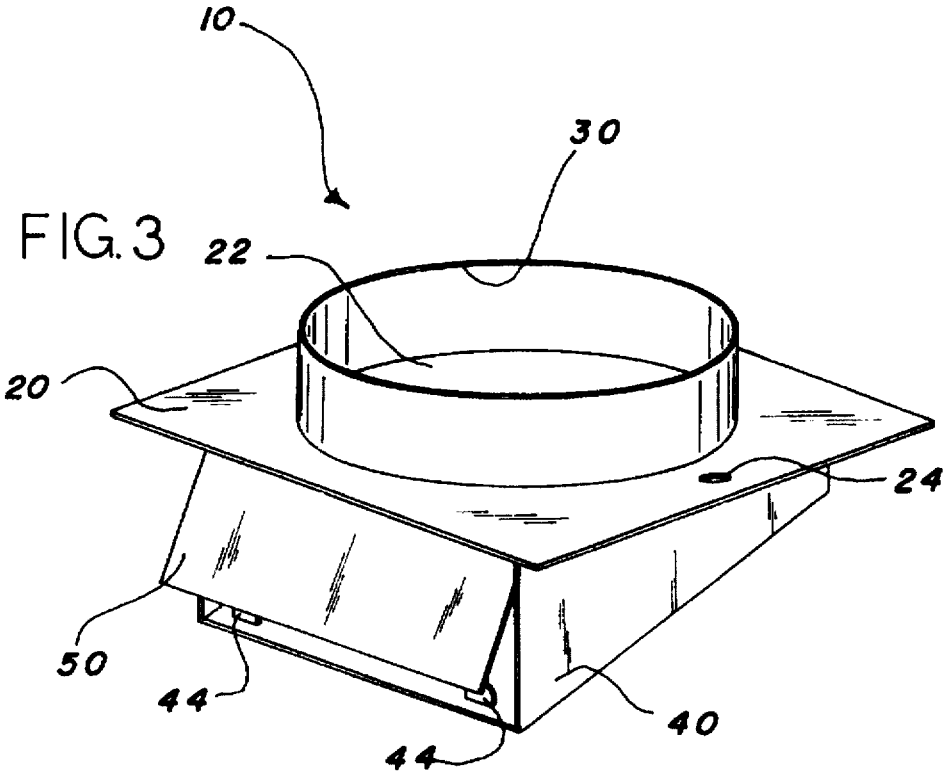
FIG. 3 is an isometric illustration of the present invention.
Figure 4:
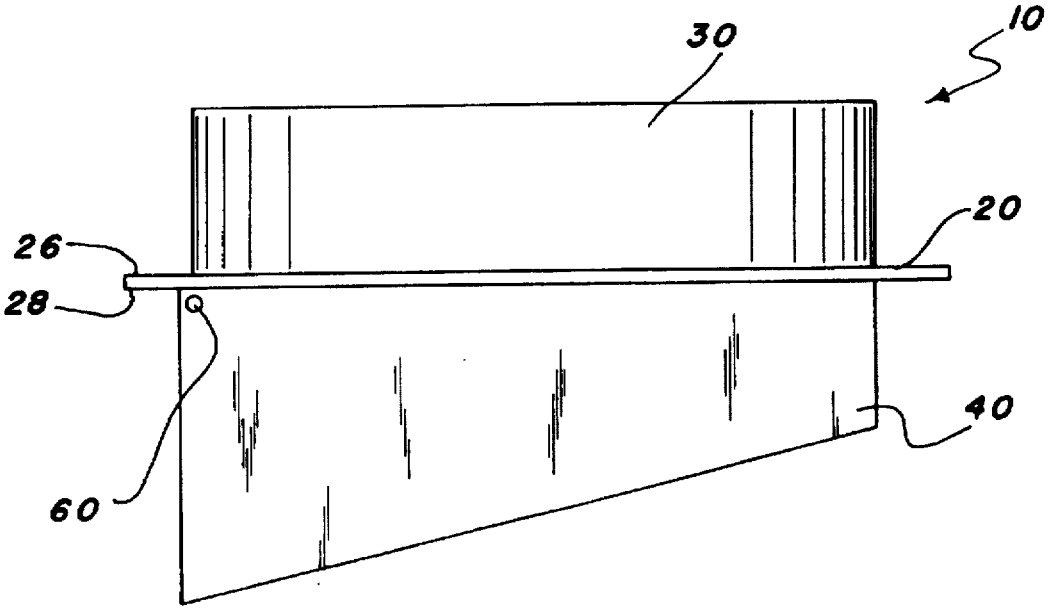
FIG. 4 is a side view of the present invention.
Figure 5:
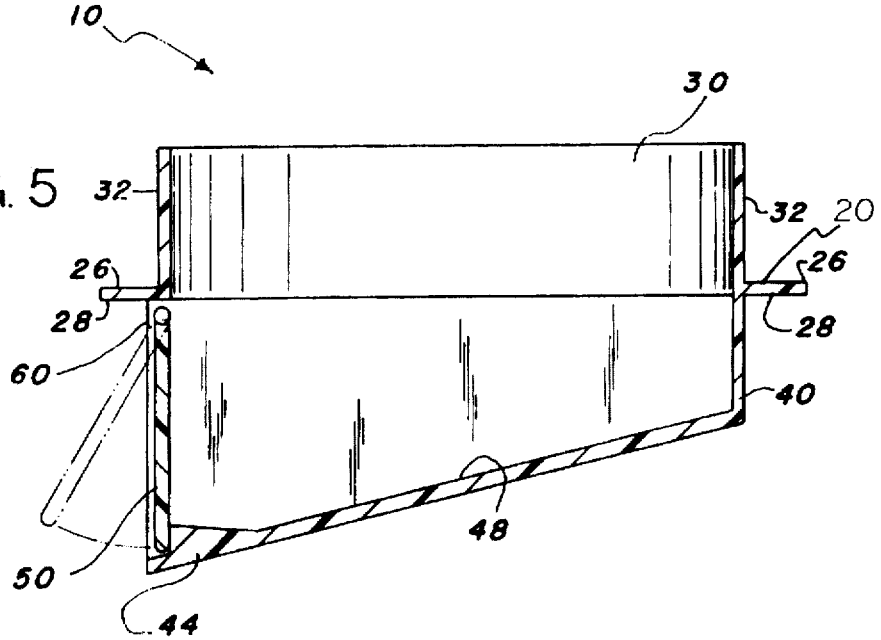
FIG. 5 is a cross sectional view taken along line 5—5 of FIG.

In use, as best illustrated in FIGS. 1 and 3, the clothes dryer vent hose 6 is slipped over the dryer hose adapter ring 30. The flange 20 is attached to a soffit 2 of a roof overhang 4 by a fastener 8, such as a screw or a nail. The fastener 8 is inserted in and driven through a mounting hole 24 in the flange 20 thus drawing the flange 20 to and flush with the soffit 2. Exhaust air from the clothes dryer vent hose 6 flows through the dryer hose adapter ring 30, through the air passage 22 of the flange 20, and through the outlet fitting 40. The force of flowing exhaust air causes the vent flapper 50 to pivot outward allowing exhaust air to exit through the outlet opening 42 of the outlet fitting 40. When no exhaust air is flowing, the flapper stop 44 prevents the vent flapper 50 from pivotally rotating into the outlet fitting 40 beyond a substantially vertical plane.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Soffit Mounted Dryer Vent for venting exhaust air from a clothes dryer vent hose that terminates in a soffit of a roof overhang comprising:

a flange having an air passage, an upper surface, and a lower surface;

a dryer hose adapter ring symmetrically mated to said upper surface of said flange, said clothes dryer vent hose matingly fitting over said dryer hose adapter ring;

an outlet fitting adjoiningly mated to said lower surface of said flange, said outlet fitting having an outlet openings, said outlet fitting communicating with said air passage of said flange whereby exhaust air flows through said dryer hose adapter ring, through said air passage, through said outlet fitting, and out said outlet opening, said flange mountable in abutting engagement with said soffit of said roof overhang whereby said dryer hose adapter ring is generally above said soffit and said outlet fitting is generally below said soffit;

a vent flapper having an upper edge and a lower edge, said vent flapper pivotally attached along said upper edge thereof to said outlet fitting at said outlet opening, said vent flapper pivotable between a closed, at rest position and an open, in use position, said vent flapper being generally vertically oriented when in said closed, at rest position, and said vent flapper pivoting outward when in said open, in use position to allow exhaust air to flow out said outlet opening of said outlet fitting, said lower end of said vent flapper pivoting beyond said outlet fitting and said vent flapper being oriented at an angle to said outlet opening when in said open, in use position whereby said vent flapper directs exhaust air generally downward away from said soffit; and a flapper stop protruding from an internal surface of said outlet fitting within said outlet opening, said flapper stop preventing said vent flapper from pivotally rotating into said outlet fitting beyond a substantially vertical plane.

2. The Soffit Mounted Dryer Vent of claim 1, wherein said vent flapper includes a pair of vent flapper pins each protruding from opposite ends of said vent flapper along said upper edge thereof, each of said pair of vent flapper pins extending through one of a pair of flapper pin retention holes provided in said outlet fitting whereby said vent flapper pivotally rotates about a longitudinal axis along said upper edge thereof.

* * * * *